US007364630B2

(12) United States Patent
Matsumoto et al.

(10) Patent No.: US 7,364,630 B2
(45) Date of Patent: Apr. 29, 2008

(54) AL-MG-SI ALLOY SHEET EXCELLENT IN SURFACE PROPERTIES, MANUFACTURING METHOD THEREOF, AND INTERMEDIATE MATERIAL IN THE MANUFACTURING THEREOF

(75) Inventors: Katsushi Matsumoto, Kobe (JP); Yasuaki Sugizaki, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 535 days.

(21) Appl. No.: 10/807,240

(22) Filed: Mar. 24, 2004

(65) Prior Publication Data

US 2004/0187985 A1 Sep. 30, 2004

(30) Foreign Application Priority Data

Mar. 27, 2003 (JP) ..... 2003-087619

(51) Int. Cl.
*C22C 21/08* (2006.01)
*C22F 1/05* (2006.01)

(52) U.S. Cl. ..... 148/415; 420/546; 148/698

(58) Field of Classification Search ..... 148/415, 148/417, 698, 695–697; 420/534, 535, 544, 420/546

See application file for complete search history.

(56) References Cited

U.S. PATENT DOCUMENTS 4,269,632 A 5/1981 Robertson et al.
5,944,923 A 8/1999 Hayashi et al.
6,231,809 B1 * 5/2001 Matsumoto et al. ..... 420/535
6,334,916 B1 * 1/2002 Matsumoto et al. ..... 148/437

FOREIGN PATENT DOCUMENTS

| | | |
|---|---|---|
| DE | 29 29 724 C2 | 2/1980 |
| DE | 692 23 435 T2 | 4/1998 |
| EP | 0 506 100 B1 | 9/1992 |
| EP | 0 507 411 B1 | 10/1992 |
| EP | 0 961 841 B1 | 12/1999 |
| JP | 4-276047 | 10/1992 |

* cited by examiner

*Primary Examiner*—Roy King
*Assistant Examiner*—Janelle Morillo
(74) *Attorney, Agent, or Firm*—Oblon, Spivak, McClelland, Maier & Neustadt, P.C.

(57) ABSTRACT

The present invention provides an Al—Mg—Si alloy sheet in which the production of ridging marks during press forming is noticeably inhibited, and in addition, provides a manufacturing method capable of providing such an aluminum alloy sheet, and an intermediate material in the manufacture thereof. The Al—Mg—Si alloy sheet in accordance with the present invention is characterized by having a prescribed composition, and characterized in that respective textures are present therein with a good balance. Further, in accordance with the manufacturing method, and the intermediate material in the manufacture thereof of the present invention, it is possible to manufacture the alloy with high efficiency.

6 Claims, 4 Drawing Sheets

AL-MG-SI ALLOY SHEET EXCELLENT IN SURFACE PROPERTIES, MANUFACTURING METHOD THEREOF, AND INTERMEDIATE MATERIAL IN THE MANUFACTURING THEREOF

BACKGROUND OF THE INVENTION

1. Field of the Invention

The present invention relates to an Al—Mg—Si alloy sheet in which ridging marks are noticeably prevented from being produced particularly during press forming, and therefore which is excellent in surface properties, a manufacturing method thereof, and an intermediate material in the manufacture thereof.

2. Related Art

An aluminum alloy material is capable of being more reduced in weight as compared with a steel material, and further is easy to recycle. For this reason, it has been utilized for a construction material, a household electrical appliance, a machine part, or the like to meet the requirements such as energy conservation and resource conservation. For utilization of the aluminum alloy material, in general, an aluminum alloy sheet obtained through a rolling process is press formed, resulting in a desired shape.

Aluminum alloy sheets excellent in press formability include an Al—Mg alloy. The Al—Mg alloy sheet has, however, a drawback that stretcher strain marks are produced during press forming. Under such circumstances, an Al—Mg—Si alloy sheet has started to attract attention as an alloy sheet for press forming.

However, for press forming an Al—Mg—Si alloy sheet, defects of surface properties referred to as "ridging marks" may be produced. The "ridging marks" are stripe-like irregularities which are produced in the direction parallel to the direction of rolling upon forming the sheet material. They are produced conspicuously especially when forming such as stretch forming, ironing, deep drawing, or bulging is performed at an angle of 90° to the direction of rolling. Such defects of surface properties raise issues especially when a product with such defects is applied to a product requiring beautifulness such as an exterior package of an interior product including a household electrical appliance or the body of an automobile.

As a technique for inhibiting the production of the ridging marks, U.S. Pat. No. 6,231,809 discloses an Al—Mg—Si alloy sheet in which the texture distribution is defined. For the aluminum alloy sheet, by defining each orientation distribution density of Goss orientation, PP orientation, and Brass orientation in which in-plane plastic anisotropy is strong, the ridging marks are inhibited from being produced. This technique yields a given result. However, in recent years, the required quality of an aluminum alloy sheet to be used for a product requiring beautifulness such as the body of an automobile has become more and more strict. This has caused a demand for an improved technique for further inhibiting the ridging marks from being produced.

Whereas, U.S. Pat. No. 5,944,923 discloses a manufacturing method of an aluminum alloy sheet for an automobile outer panel, with a consideration given to formability and also to the product surface quality including the inhibition of production of ridging marks. However, this technology does not include a detailed examination on the fraction of the crystal orientation texture exerting a large influence on the ridging marks, and hence it has not been satisfactory in terms of the surface properties.

As described above, an Al—Mg—Si alloy produced with a consideration given to the formability and also to the inhibition of production of the ridging marks has been known, however, its effects have not been necessarily satisfactory.

SUMMARY OF THE INVENTION

It is therefore an object of the present invention to provide an Al—Mg—Si alloy sheet in which ridging marks are noticeably prevented from being produced during press forming, and, in addition, to provide a manufacturing method capable of providing such an aluminum alloy sheet, and an intermediate material in the manufacture thereof.

The inventors of the present invention prepared various Al—Mg—Si alloy sheets in order to achieve the foregoing object, and repeatedly conducted a close study on the relationship between the crystal orientation textures and whether ridging marks are produced or not during press forming. As a result, they found out as follows. The foregoing problem can be solved by proper control of particularly the distribution of each crystal orientation component along the sheet width direction for the texture components exerting an influence on the production of ridging marks. Thus, the inventors completed the present invention.

Namely, the Al—Mg—Si alloy sheet of the present invention comprises Mg in an amount of 0.1 to 3.0 mass % and Si in an amount of 0.1 to 2.5 mass %, wherein respective textures of Cube orientation, CR orientation, RW orientation, Goss orientation, Brass orientation, S orientation, Cu orientation, and PP orientation satisfy the conditions of the following expression (1):

$$([Cube]+[CR]+[RW]+[Goss]+[Brass]+[S]+[Cu]+[PP])/8 \leqq 1.0\ (\%) \quad (1)$$

(where [x] denotes the standard deviation (%) of the area ratio of an orientation x in a sheet cross section every 500 μm along the sheet width direction).

The Al—Mg—Si alloy sheet preferably comprises, as its constituent components, one, or not less than two selected from the group consisting of 1.0 mass % or less of Fe, 0.3 mass % or less of Mn, 0.3 mass % or less of Cr, 0.3 mass % or less of Zr, 0.3 mass % or less of V, and 0.1 mass % or less of Ti, and 1.0 mass % or less of Cu and/or 1.0 mass % or less of Zn (each not including 0 mass %). This is for the following reason. It is possible to impart the characteristics exerted by the respective constituent components to the aluminum alloy sheet. For example, it is possible to improve the press formability.

An intermediate material in the manufacture of the Al—Mg—Si alloy excellent in surface properties in accordance with the present invention comprises Mg in an amount of 0.1 to 3.0 mass % and Si in an amount of 0.1 to 2.5 mass %, and is in the shape of a sheet, characterized in that the average value of the sizes along the sheet thickness direction of textures of respective orientations is set at 50 μm or less.

Such an intermediate material in the manufacture of the Al—Mg—Si alloy can provide an aluminum alloy sheet in which the production of ridging marks during press forming is inhibited.

The inventors of the present invention found out the following fact. In order to control the balance of the texture distribution, and further to inhibit the production of ridging marks during press forming, it is important to define the textures of the intermediate material in the manufacture of an aluminum alloy sheet, i.e., the sheet immediately before cold rolling or during cold rolling, after hot rolling. Further, by judging whether the definition is satisfied or not, it becomes possible to predict to a certain degree the quality of the final aluminum alloy sheet. Based on this finding, the inventors defined them.

In a method for manufacturing an aluminum alloy sheet of the present invention, it is preferable that the alloy sheet is subjected to annealing before cold rolling and/or intermediate annealing during cold rolling after having undergone a hot rolling step, wherein the respective annealing conditions are set such that the annealing temperature is 150 to 320° C. and the annealing time is 20 hours or more. This is for the following reason. By carrying out annealing at a relatively low temperature, the coarse recrystallized grain formation during annealing is inhibited. This allows the sheet to hold accumulated strain, and increases the amount of precipitates. As a result, the accumulation of dislocation in the vicinity of the precipitates during cold rolling is promoted, and further the formation of nucleuses of random recrystallization orientations caused by the precipitates is promoted during solid solution treatment, which allows the reduction in standard deviation of the crystal orientation area ratio along the sheet width direction.

The Al—Mg—Si alloy sheet of the present invention is capable of remarkably inhibiting the production of ridging marks which tend to be produced during press forming.

Further, the manufacturing methods of the Al—Mg—Si alloy sheet and the intermediate material in the manufacturing of the Al—Mg—Si alloy in accordance with the present invention are useful as being applicable to the manufacturing of the aluminum alloy sheet.

Therefore, the present invention regarding the Al—Mg—Si alloy sheet is very useful from the industrial viewpoint as being applicable to construction materials for roofs, interior members, curtain walls, and the like, materials for utensils, household electrical appliance, optical instruments, outer panels of automobiles, railcars, aircraft, and the like, general mechanical parts, and the like.

DETAILED DESCRIPTION OF THE PREFERRED EMBODIMENTS

Figure 1:
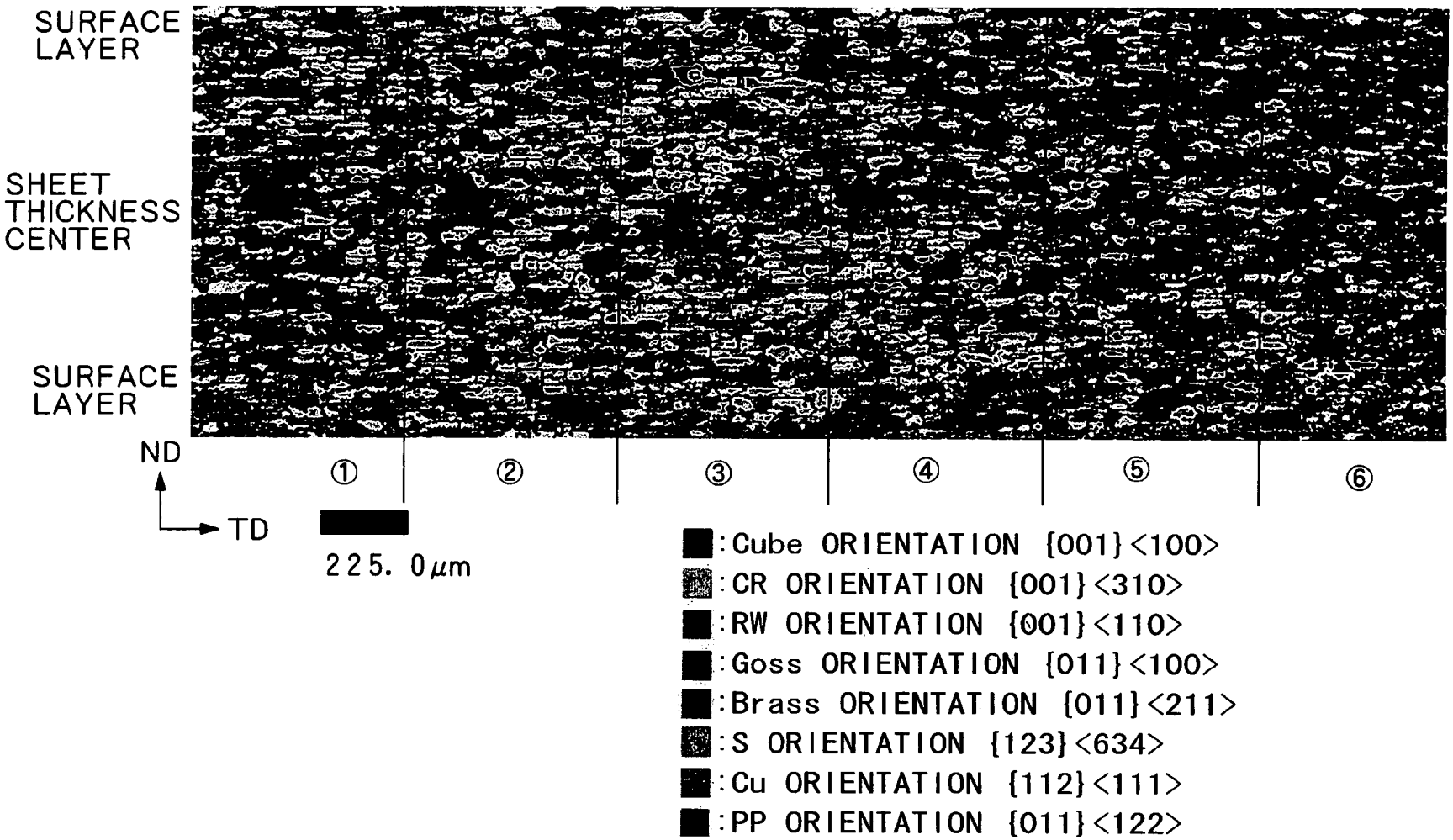
FIG. 1 shows the EBSP analysis results on an alloy sheet of alloy No. 3.

The largest feature of an Al—Mg—Si alloy sheet in accordance with the present invention resides in the following point. By defining particularly the fraction of each crystal orientation texture, it is possible to conspicuously inhibit ridging marks from being produced during press forming.

Namely, an Al—Mg—Si alloy sheet intended for ensuring the strength and the formability, and the inhibition of the production of ridging marks has been conventionally developed. However, it cannot necessarily eliminate the production of the ridging marks. The inventors of the present invention, however, found out that the ridging marks produced during press forming are caused by specific crystal orientations. Then, they found as follows. When the presence thereof is defined with good balance, the ridging marks can be conspicuously inhibited from being produced. Thus, the inventors completed the present invention.

Below, embodiments of the present invention showing such features, and the effects thereof will be described.

An Al—Mg—Si system aluminum alloy is selected in the present invention because it is very excellent as a forming material for the following reasons. Stretcher strain marks are less likely to be produced during press forming than with an Al—Mg alloy. Further, the Al—Mg—Si system aluminum alloy is excellent in formability and corrosion resistance at room temperature, and further it is capable of acquiring high strength by aging.

In the present invention, Mg is added in an amount of 0.1 to 3.0 mass %, and Si is added in an amount of 0.1 to 2.5 mass %. These elements form aggregates (clusters) of a composition of $Mg_2Si$ referred to as GP zones, or intermediate phases, and are capable of improving the effects by a baking treatment. The contents of less than their respective lower limits or more than their respective upper limits cannot produce such an effect. Particularly the contents of less than their respective lower limit values result in deterioration of the formability. Further, when the Si content exceeds the upper limit value, a coarse simple substance Si crystallized product is formed, resulting in deterioration of the formability.

The gist of the present invention resides in that the crystal orientation texture of an Al—Mg—Si alloy is defined. In a conventional aluminum alloy, it is known that there exist the following crystal orientations. A change in volume fraction results in a change in plastic anisotropy.

Cube orientation: {001} <100>

CR orientation: {001} <310>

RW orientation: {001} <110> (orientation obtained by rotating the sheet plane of Cube orientation)

Goss orientation: {011} <100>

Brass orientation: {011} <211>

S orientation: {123} <634>

Cu orientation: {112} <111>

(or D orientation: {4 4 11} <11 11 8>

PP orientation: {011} <122>, or the like

Herein, the manner in which the texture is produced varies according to the processing method thereof even in the same crystal system. For a sheet material by rolling, the manner is required to be represented by the rolling plane and the rolling direction. Namely, in each of the aforesaid orientations, the rolling plane is expressed as {○○○}, and the rolling direction is expressed as {ΔΔΔ} (where ○ and Δ each represent an integer) (see, "Texture" edited and written by Shinnichi Nagashima, (published by Maruzen Kabushiki Kaisha), and Metallurgical Society Seminar "Light Metal" Commentary Vol. 43, p.p. 285 to 293 (1993)).

In the present invention, it is basically defined that crystal orientations deviating from each of the foregoing crystal planes by ±10 degrees or less belong to the same orientation factor. This is because the crystal orientations within such a range exhibit roughly the same property.

In the present invention, the respective orientations of Cube orientation, CR orientation, RW orientation, Goss orientation, Brass orientation, S orientation, Cu orientation, and PP orientation are defined so as to meet the following condition (1):

$$([Cube]+[CR]+[RW]+[Goss]+[Brass]+[S]+[Cu]+[PP])/8 \leqq 1.0\ (\%) \quad (1)$$

(where [x] denotes the standard deviation (%) of the area ratio of orientation x in sheet cross section every 500 μm along the sheet width direction).

The ridging marks produced during press forming appear as irregularities of the alloy sheet surface layer. A detailed study has revealed the following fact. The accumulated amount of plastic deformation of the whole sheet thickness along the sheet thickness direction forms the irregularities of the surface layer portion, which results in the ridging marks. In other words, whether the ridging marks are produced or not is determined by the degree of the area ratio distribution of respective crystal orientation components along the sheet width direction. A detailed analysis by the present inventors indicates the following result. The ridging marks are more inhibited from being produced with a decrease in standard deviation of the area ratio distribution of respective crystal orientations along the sheet width direction. When the left-hand side of the expression (1) exceeds 1.0%, the ridging marks tend to be produced. The value is preferably 0.8% or less (≦0.8), and further preferably 0.6% or less.

However, when Goss orientation, Brass orientation, or PP orientation out of the foregoing crystal orientations is grown more remarkably than random orientations, the ridging marks may be often produced. Therefore, [Goss], [Brass], or [PP] is each preferably 3% or less. Whereas, [Cube] is preferably 10% or less for the same reason.

For the quantitative evaluation of the texture distribution in the present invention, measurements are preferably carried out by means of an electron diffraction method by TEM (Transmission Electron Microscopy), SEM-ECP (Scanning Electron Microscopy Electron Channeling Pattern) method, or SEM-EBSP (Electron Back Scattered Pattern) method. Evaluations are made in terms of the area ratios (%) based on the obtained measured data.

The measuring sites are set at the cross sections along the sheet width direction, and the measurements are preferably carried out at portions at a depth of ¼ the sheet thickness from the surface of the alloy sheet. This is for the following reason. When the requirements as to the texture distribution of the expression (1) are satisfied at the portions, it can be concluded that the ridging marks are inhibited from being produced throughout the aluminum alloy sheet. The measurements are carried out in the following manner. A given length (e.g., 3 mm) along the sheet width direction is set in the cross section, within the range of which measurements are carried out every 500 μm. A plurality of measuring sites (e.g., 10 sites) is preferably set in order to ensure more accuracy.

The Al—Mg—Si alloy sheet in accordance with the present invention may contain, as the composition, one, or not less than two selected from the group consisting of 1.0 mass % or less of Fe, 0.3 mass % or less of Mn, 0.3 mass % or less of Cr, 0.3 mass % or less of Zr, 0.3 mass % or less of V, and 0.1 mass % or less of Ti (each not including 0 mass %). Fe forms Fe-containing crystallized products (such as α-AlFeSi, β-AlFeSi, $Al_6Fe$, $Al_6(Fe, Mn)_3Cu_{12}$, and $Al_7Cu_2Fe$), and thereby it is capable of exhibiting a crystal grain size reducing effect. However, when the content exceeds the upper limit value, coarse constituents are formed, resulting in deterioration of the formability. Mn, Cr, Zr, V, and Ti also have the grain size reducing effect, and have an effect of improving the formability. However, when the content thereof exceeds the upper limit, they form coarse compounds, which result in the starting points of destruction to deteriorate the formability.

Further, the alloy sheet may contain 1.0 mass % or less of Cu and/or 1.0 mass % or less of Zn (each not including 0 mass %) This is because these elements improve the age-hardening rate during baking. However, when each content exceeds the upper limit value, it forms coarse compounds, resulting in deterioration of the formability. Particularly, excess Cu also deteriorates the corrosion resistance.

Other than the foregoing respective elements, desirable elements may also be added in order to enhance various characteristics of the alloy. However, the balance except for the foregoing requirements comprises inevitably contained elements (inevitable impurities) present therein, and in addition, preferably Al.

In order to manufacture an Al—Mg—Si alloy sheet having the crystal orientation composition described above, i.e., to control the textures of an alloy sheet, it is important to control the conditions elaborately in a general manufacturing method of an aluminum alloy sheet including at least hot rolling and cold rolling.

Specific process conditions in such manufacturing steps vary according to the balance between the composition of the alloy and other process conditions, and hence cannot be determined indiscriminately. However, the inventors of the present invention conducted a close examination on the change in texture during manufacturing steps in addition to the texture form exerting an influence on the production of ridging marks during press forming, and reached the following findings.

First, "the starting temperature of hot rolling" is set relatively lower. This is for the following reason. By setting the temperature at a low temperature, the coarse recrystallized crystal grain formation during hot rolling is inhibited, so that the standard deviation of the crystal orientation along the sheet width direction is reduced. Specifically, the temperature is preferably 500° C. or less, further preferably 400° C. or less, and most suitably 300° C. or less.

"The finishing temperature of hot rolling" is also set relatively lower. This is for the same reason as described above that the coarse recrystallized grain formation upon coiling after hot rolling is inhibited to reduce the standard deviation along the sheet width direction. The temperature is preferably 250° C. or less, further preferably 220° C. or less, and most suitably 200° C. or less.

"Annealing before cold rolling" is preferably carried out at a relatively low temperature between the hot rolling step and the cold rolling step. Alternatively, "intermediate annealing during cold rolling" may be carried out at a relatively low temperature. The sheet undergoes the step, which inhibits the coarse recrystallized grain formation during cold rolling. This allows the sheet to hold accumulated strain, and increases the amount of precipitates. As a result, the accumulation of dislocation in the vicinity of the precipitates during cold rolling is promoted, and further the formation of nucleuses of random recrystallization orientations caused by the precipitates is promoted during solid solution treatment, which allows the reduction in standard deviation in the same manner as described above. The annealing conditions are as follows: preferably 150 to 320° C. for 20 hours or more, further preferably 150 to 280° C. for 30 hours or more, and most suitably 150 to 250° C. for 40 hours or more.

The "cold rolling reduction" in the cold rolling step (the total cold rolling reduction for the case where intermediate annealing is carried out in between) is preferably set at 70% or more. This is for the following reason. An increase in cold rolling reduction increases the accumulation of dislocation in the vicinity of the precipitates, which allows the promotion of the formation of nucleuses of random recrystallization orientations during solid solution treatment. The "cold rolling reduction" is further preferably 80% or more, and most suitably 90% or more.

Further, the inventors of the present invention found out the following fact. When the average value of the size along the sheet thickness direction of each crystal orientation texture after the intermediate annealing immediately before the cold rolling step or during the cold rolling is set at 50 μm or less, it is possible to inhibit the production of the ridging marks in a final aluminum alloy sheet. In other words, if the average value at this time point is determined, it is possible to predict the properties of the final alloy sheet, and the determined value can be used as a guide for determining the manufacturing process conditions. The average value is further preferably 40 μm or less, and still further preferably 30 μm or less. Incidentally, the respective crystal orientation textures are not limited to specific textures, but mainly denote the aforesaid textures of (Cube orientation, CR orientation, RW orientation, Goss orientation, Brass orientation, S orientation, and PP orientation).

Further, the intermediate material in the manufacture of an Al—Mg—Si alloy in which the average value of the sizes along the sheet thickness direction of respective crystal orientation textures after the intermediate annealing immediately before the cold rolling step or during the cold rolling is 50 μm or less, (preferably 40 μm or less, and further preferably 30 μm or less) is useful as the one capable of providing an aluminum alloy sheet in which the production of ridging marks during press forming is inhibited. It is considered that such a state in the intermediate material in the manufacturing thereof exerts a large influence on the production of ridging marks when the aluminum alloy sheet of the final product is press formed.

As described above, the manufacturing method described above is absolutely a preferred example for manufacturing the alloy sheet of the present invention. The alloy sheet of the present invention can also be manufactured by manufacturing methods other than the method satisfying the foregoing conditions. Namely, in order to obtain the alloy sheet of the present invention, the conditions are required to be controlled by the balance between the composition of the alloy and the process conditions. However, it can be said that at least the alloy sheet obtained by the manufacturing method including a process largely deviating from the foregoing conditions does not have the texture distribution in accordance with the present invention, and may undergo the production of ridging marks therein during press forming.

Below, the present invention will be described in more details by way of examples. However, the scope of the present invention is not limited thereto.

EXAMPLES

Manufacturing Example

Al alloys of the respective compositions (in each of which the balance is composed of Al and inevitable impurities) shown in Table 1 were molten, and made into ingots by DC casting or sheet continuous casting.

TABLE 1

| No. | Mg | Si | Fe | Mn | Cr | Zr | V | Ti | Cu | Zn | Remarks |
|---|---|---|---|---|---|---|---|---|---|---|---|
| 1 | 0.5 | 1.0 | 0.2 | | | | | | | | |
| 2 | 0.5 | 1.0 | 0.2 | | | | | 0.03 | | | |
| 3 | 0.4 | 0.9 | 0.9 | | | | | 0.10 | | | |
| 4 | 1.9 | 1.9 | 0.15 | 0.05 | | | | | | | |
| 5 | 0.25 | 0.2 | 0.4 | | 0.05 | | | | | | |
| 6 | 0.5 | 1.2 | 0.2 | 0.1 | | 0.3 | | | | | |
| 7 | 0.9 | 0.8 | 0.2 | | 0.3 | | 0.05 | | | | |
| 8 | 0.7 | 1.4 | 0.5 | 0.05 | | | | | 1.0 | | |
| 9 | 0.5 | 1.1 | 0.2 | 0.3 | | 0.05 | | | | | |
| 10 | 0.6 | 1.2 | 0.2 | | 0.1 | | 0.3 | | | | |
| 11 | 0.5 | 1.0 | 0.3 | | | | | | 0.2 | | |
| 12 | 0.4 | 0.8 | 0.6 | 0.05 | | | | | | 1.0 | |
| 13 | 0.6 | 1.3 | 0.25 | | | 0.05 | | | | 0.2 | |
| 14 | 0.5 | 1.0 | 0.2 | 0.5 | | | | 0.02 | | | |
| 15 | 0.6 | 2.1 | 0.25 | 0.05 | | | | 0.01 | | | |
| 16 | 0.8 | 1.2 | 0.2 | 0.1 | | 0.4 | | | | | |
| 17 | 0.4 | 0.6 | 1.2 | | 0.1 | | | 0.01 | | | |
| 18 | 0.5 | 1.0 | 0.5 | 0.1 | | | 0.5 | 0.02 | | | |
| 19 | 0.6 | 1.4 | 0.3 | | | 0.1 | | 0.2 | | | |
| 20 | 1.6 | 0.4 | 0.2 | | | | | | 1.2 | | |
| 21 | 0.8 | 0.9 | 0.4 | | 0.1 | | | | | 1.2 | |
| 22 | 0.5 | 1.0 | 0.2 | | | | | 0.03 | | | The same composition as that of No. 2 |
| 23 | 1.9 | 1.9 | 0.15 | 0.05 | | | | | | | The same composition as that of No. 4 |
| 24 | 0.25 | 0.2 | 0.4 | | 0.05 | | | | | | The same composition as that of No. 5 |
| 25 | 0.5 | 1.2 | 0.2 | 0.1 | | 0.3 | | | | | The same composition as that of No. 6 |
| 26 | 0.9 | 0.8 | 0.2 | | 0.3 | | 0.05 | | | | The same composition as that of No. 7 |
| 27 | 0.7 | 1.4 | 0.5 | 0.05 | | | | | 1.0 | | The same composition as that of No. 8 |

TABLE 1-continued

| No. | Mg | Si | Fe | Mn | Cr | Zr | V | Ti | Cu | Zn | Remarks |
|---|---|---|---|---|---|---|---|---|---|---|---|
| 28 | 0.4 | 0.8 | 0.6 | 0.05 | | | | | | 1.0 | The same composition as that of No. 12 |

The ingots thus obtained were each subjected to treatments of hot rolling, annealing before cold rolling, and cold rolling (wherein in some cases, intermediate annealing was performed) in accordance with Table 2, and further subjected to a solid solution treatment at 550° C. for 60 seconds. As a result, 1 mm-thick T4 materials were obtained.

TABLE 2

| | Manufacturing conditions | | | | | |
|---|---|---|---|---|---|---|
| Alloy No. | Hot rolling starting temperature (° C.) | Hot rolling finishing temperature (° C.) | Conditions for annealing before cold rolling (° C. × hr) | Intermediate cold rolling reduction (%) | Intermediate annealing conditions (° C. × hr) | Final cold rolling reduction (%) |
| 1 | 480 | 220 | 300, 30 | None | None | 78 |
| 2 | 500 | 250 | 290, 24 | None | None | 72 |
| 3 | 400 | 220 | 275, 30 | None | None | 80 |
| 4 | 380 | 200 | 280, 45 | None | None | 88 |
| 5 | 460 | 200 | 280, 20 | None | None | 74 |
| 6 | 400 | 210 | 280, 40 | None | None | 87 |
| 7 | 300 | 200 | 250, 40 | None | None | 90 |
| 8 | 460 | 240 | 320, 24 | 60 | 220, 30 | 60 |
| 9 | 290 | 190 | 230, 48 | None | None | 92 |
| 10 | 300 | 200 | 210, 45 | 50 | 180, 40 | 85 |
| 11 | 380 | 215 | 265, 36 | None | None | 82 |
| 12 | 440 | 230 | 290, 24 | None | None | 80 |
| 13 | 350 | 180 | 260, 40 | 55 | 200, 30 | 75 |
| 14 | 520 | 320 | 300, 24 | None | None | 70 |
| 15 | 480 | 400 | 280, 30 | None | None | 80 |
| 16 | 520 | 200 | None | None | None | 70 |
| 17 | 450 | 300 | 350, 20 | 30 | 400, 6 | 50 |
| 18 | 550 | 250 | 350, 8 | None | None | 70 |
| 19 | 500 | 350 | 440, 20 | None | None | 65 |
| 20 | 460 | 300 | 300, 10 | None | None | 60 |
| 21 | 480 | 250 | 350, 6 | 50 | 350, 10 | 30 |
| 22 | 520 | 320 | 300, 24 | None | None | 70 |
| 23 | 480 | 400 | 280, 30 | None | None | 80 |
| 24 | 520 | 200 | None | None | None | 70 |
| 25 | 450 | 300 | 350, 20 | 30 | 400, 6 | 50 |
| 26 | 550 | 250 | 350, 8 | None | None | 70 |
| 27 | 500 | 350 | 440, 20 | None | None | 65 |
| 28 | 480 | 250 | 350, 6 | 50 | 350, 10 | 30 |

Test Example 1

Evaluation of Texture and Ridging Evaluation

As for each T4 material manufactured in accordance with the Manufacturing Example, crystal orientation distribution measurements at 10 visual fields (10 sites) were carried out by an SEM-EBSP method for an area of 3 mm along the sheet width direction in the right-angled cross section of the alloy sheet. The area ratio of each orientation component was calculated every 500 μm width to calculate the standard deviation of each orientation component.

Whereas, for each sample before cold rolling, the measurements of the orientation distributions at 10 visual fields were carried out similarly by an SEM-EBSP (Electron Back Scattering (Scattered) Pattern) method to determine the size of each crystal orientation component along the sheet thickness direction. As an SEM apparatus, SEM (JEOL JSM 5410) manufactured by JEOL Ltd., or FE-SEM (Field Emission Scanning Electron Microscopy) (XL30S-FEG) manufactured by Philips Co., was used. As the EBSP measurement/analysis system, EBSP (OIM) manufactured by TSL Co., was used.

FIG. 1 shows the EBSP analysis result for an alloy sheet of alloy No. 3. In accordance with the EBSP analysis, it is possible to recognize each crystal orientation by color, and hence it is possible to calculate each area ratio with ease.

Further, ridging evaluation was carried out on each T4 material. The riding evaluation was carried out in the following manner. Five-percent tensile deformation was applied in a direction perpendicular to the direction of rolling of the material, and the material was subjected to a coating treatment for ease of evaluation. Thus, visual evaluation was carried out. The coating treatment was carried out by performing coating and baking treatments after a zinc phosphate treatment. Specifically, the sheet was treated with a colloidal dispersion of titanium phosphate, and then dipped in a zinc phosphate bath containing fluorine in a low concentration (50 ppm), thereby to form a zinc phosphate film on the formed material surface. The subsequent coating treatment was carried out under the following conditions. After carrying out cationic electrodeposition, 170° C.×20 minutes baking is carried out.

Figure 2:
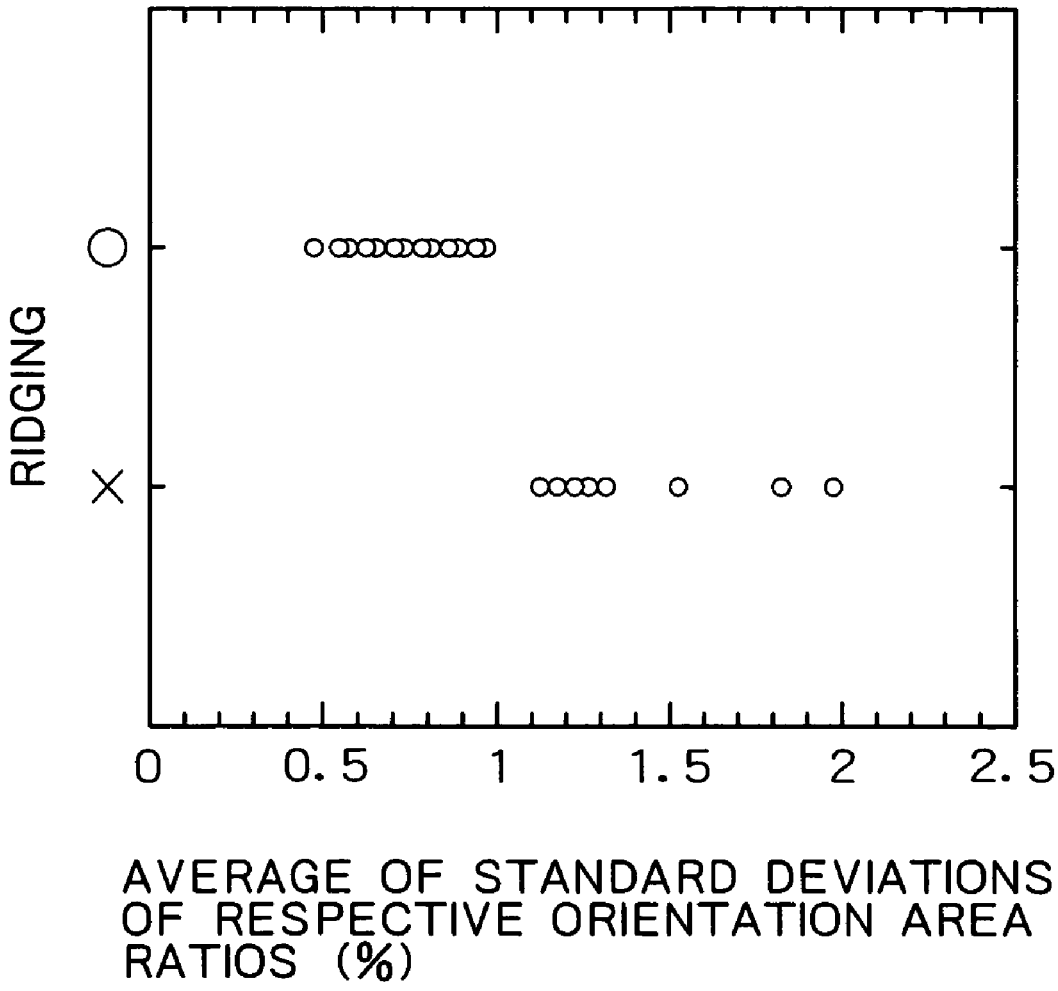
FIG. 2 is a graph showing the relationship between the average value of the standard deviations of respective crystal orientation area ratios (the left-hand side of the expression (1)) and the production or non-production of ridging marks.

Table 3 shows the standard deviation (%) of each orientation area ratio obtained by the EBSP analysis. Table 4 shows the value of the left-hand side (average of standard deviations of respective orientation area ratios, %) of the expression (1) calculated from the results, the crystal size along the sheet thickness direction before cold rolling, and the production or non-production of ridging marks. FIG. 2 shows the relationship between the average of standard deviations of respective orientation area ratios and the production or non-production of ridging marks.

TABLE 3

| No. | [Cube] | [CR] | [RW] | [Goss] | [Brass] | [S] | [Cu] | [PP] |
|---|---|---|---|---|---|---|---|---|
| 1 | 1.12 | 1.32 | 1.18 | 0.57 | 0.87 | 0.71 | 0.60 | 0.88 |
| 2 | 1.33 | 1.19 | 1.42 | 0.81 | 0.78 | 0.84 | 0.58 | 0.85 |
| 3 | 0.80 | 1.02 | 0.87 | 0.61 | 0.81 | 0.63 | 0.54 | 0.71 |
| 4 | 0.83 | 0.85 | 0.79 | 0.54 | 0.63 | 0.65 | 0.52 | 0.56 |
| 5 | 0.91 | 0.84 | 0.75 | 0.86 | 0.93 | 0.99 | 0.78 | 0.86 |
| 6 | 0.78 | 0.62 | 0.56 | 0.79 | 0.81 | 0.88 | 0.63 | 0.71 |
| 7 | 0.68 | 0.62 | 0.72 | 0.51 | 0.56 | 0.53 | 0.55 | 0.54 |
| 8 | 1.01 | 1.34 | 1.06 | 0.55 | 0.79 | 0.84 | 0.91 | 1.12 |
| 9 | 0.61 | 0.45 | 0.49 | 0.45 | 0.51 | 0.40 | 0.46 | 0.50 |
| 10 | 0.62 | 0.59 | 0.54 | 0.48 | 0.56 | 0.57 | 0.57 | 0.49 |
| 11 | 0.95 | 0.83 | 0.75 | 0.71 | 0.88 | 0.61 | 0.83 | 0.75 |
| 12 | 0.87 | 1.08 | 0.89 | 0.48 | 0.83 | 0.92 | 0.81 | 0.92 |
| 13 | 0.92 | 0.66 | 0.86 | 0.74 | 0.52 | 0.51 | 0.48 | 0.44 |
| 14 | 1.70 | 1.43 | 1.72 | 1.84 | 0.57 | 1.76 | 0.65 | 2.6 |
| 15 | 2.71 | 2.46 | 2.11 | 1.88 | 1.04 | 1.78 | 0.76 | 1.94 |
| 16 | 1.59 | 1.99 | 1.35 | 1.43 | 0.81 | 1.36 | 0.91 | 0.75 |
| 17 | 2.77 | 2.83 | 2.51 | 1.96 | 0.79 | 1.68 | 1.43 | 1.86 |
| 18 | 1.41 | 1.74 | 1.22 | 1.24 | 1.26 | 0.69 | 0.93 | 0.94 |
| 19 | 2.03 | 1.26 | 1.48 | 2.10 | 0.89 | 0.75 | 0.71 | 0.64 |
| 20 | 1.41 | 0.79 | 0.93 | 1.56 | 1.89 | 1.22 | 1.34 | 1.48 |
| 21 | 0.88 | 1.93 | 1.68 | 0.71 | 1.33 | 1.15 | 1.06 | 0.59 |
| 22 | 1.30 | 1.84 | 1.18 | 2.01 | 0.80 | 1.48 | 0.87 | 2.20 |
| 23 | 2.20 | 2.90 | 1.98 | 1.43 | 1.27 | 1.49 | 1.03 | 1.85 |
| 24 | 1.62 | 1.48 | 1.89 | 1.91 | 1.05 | 1.18 | 0.88 | 0.56 |
| 25 | 2.36 | 2.41 | 2.84 | 1.59 | 1.18 | 0.94 | 1.28 | 2.03 |
| 26 | 1.05 | 2.10 | 1.38 | 1.66 | 1.49 | 1.31 | 0.98 | 1.14 |
| 27 | 1.59 | 1.31 | 1.27 | 1.93 | 0.90 | 0.68 | 0.65 | 0.62 |
| 28 | 0.82 | 1.56 | 1.27 | 0.91 | 1.28 | 1.12 | 1.18 | 0.76 |

TABLE 4

| Alloy No. | Crystal size along sheet thickness direction before cold rolling (μm) | Standard deviation average (%) | Ridging |
|---|---|---|---|
| 1 | 46 | 0.91 | ○ |
| 2 | 48 | 0.98 | ○ |
| 3 | 38 | 0.75 | ○ |
| 4 | 40 | 0.67 | ○ |
| 5 | 45 | 0.87 | ○ |
| 6 | 41 | 0.72 | ○ |
| 7 | 37 | 0.59 | ○ |
| 8 | 47 | 0.95 | ○ |
| 9 | 30 | 0.48 | ○ |
| 10 | 33 | 0.55 | ○ |
| 11 | 43 | 0.79 | ○ |
| 12 | 44 | 0.83 | ○ |
| 13 | 39 | 0.64 | ○ |
| 14 | 65 | 1.53 | X |
| 15 | 90 | 1.84 | X |
| 16 | 54 | 1.27 | X |
| 17 | 127 | 1.98 | X |
| 18 | 72 | 1.18 | X |
| 19 | 76 | 1.23 | Δ |
| 20 | 80 | 1.33 | X |
| 21 | 68 | 1.17 | Δ |
| 22 | 71 | 1.46 | X |
| 23 | 84 | 1.77 | X |
| 24 | 58 | 1.32 | X |
| 25 | 141 | 1.83 | X |
| 26 | 69 | 1.39 | X |
| 27 | 91 | 1.12 | Δ |
| 28 | 59 | 1.11 | Δ |

In Table 4 and FIG. 2, the mark × denotes the case where the production of ridging marks was observed; the mark ○ represents the case where no production was observed; and the mark Δ represents the case where ridging marks cannot be said to have been produced, but surface roughness was observed.

The foregoing results have revealed the clear results as follows. When the standard deviation average (%) of the area ratios in sheet cross sections every 500 μm width along the sheet width direction of each crystal orientation calculated from the left-hand side of the expression (1) exceeds 1.0%, ridging marks are produced, whereas, when the standard deviation average is 1.0% or less, ridging marks are inhibited from being produced.

Figure 3:
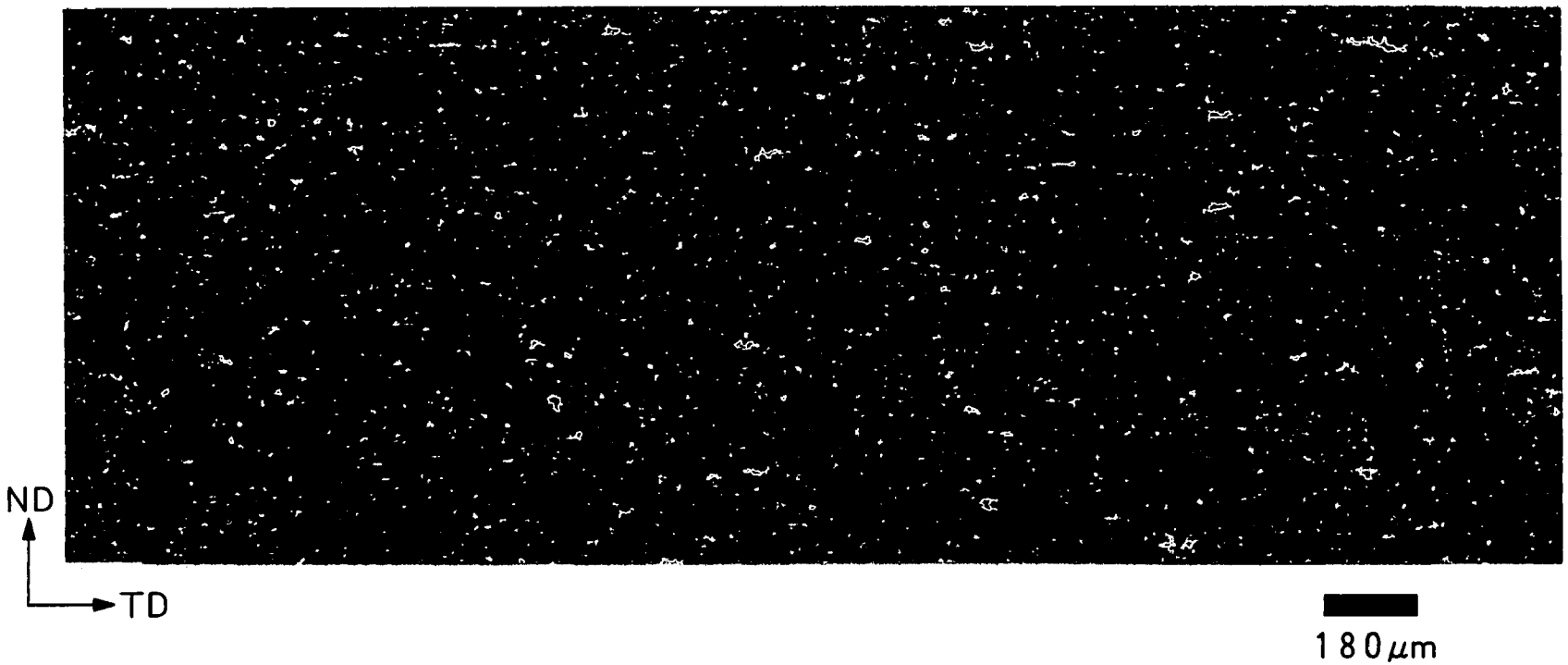
FIG. 3 shows the EBSP analysis results immediately before a cold rolling step of alloy No. 3.

Further, FIG. 3 shows the EBSP analysis result immediately before cold rolling at the ¼ t portion (the ¼ portion along the sheet thickness direction) of No. 3 alloy sheet. FIG. 3 indicates as follows. The size along the sheet thickness direction of each crystal orientation was sufficiently small, and the calculated average value was 38 μM, which is not more than 50 μm (No. 3 of Table 4). As a result, no ridging mark was produced.

Figure 4:
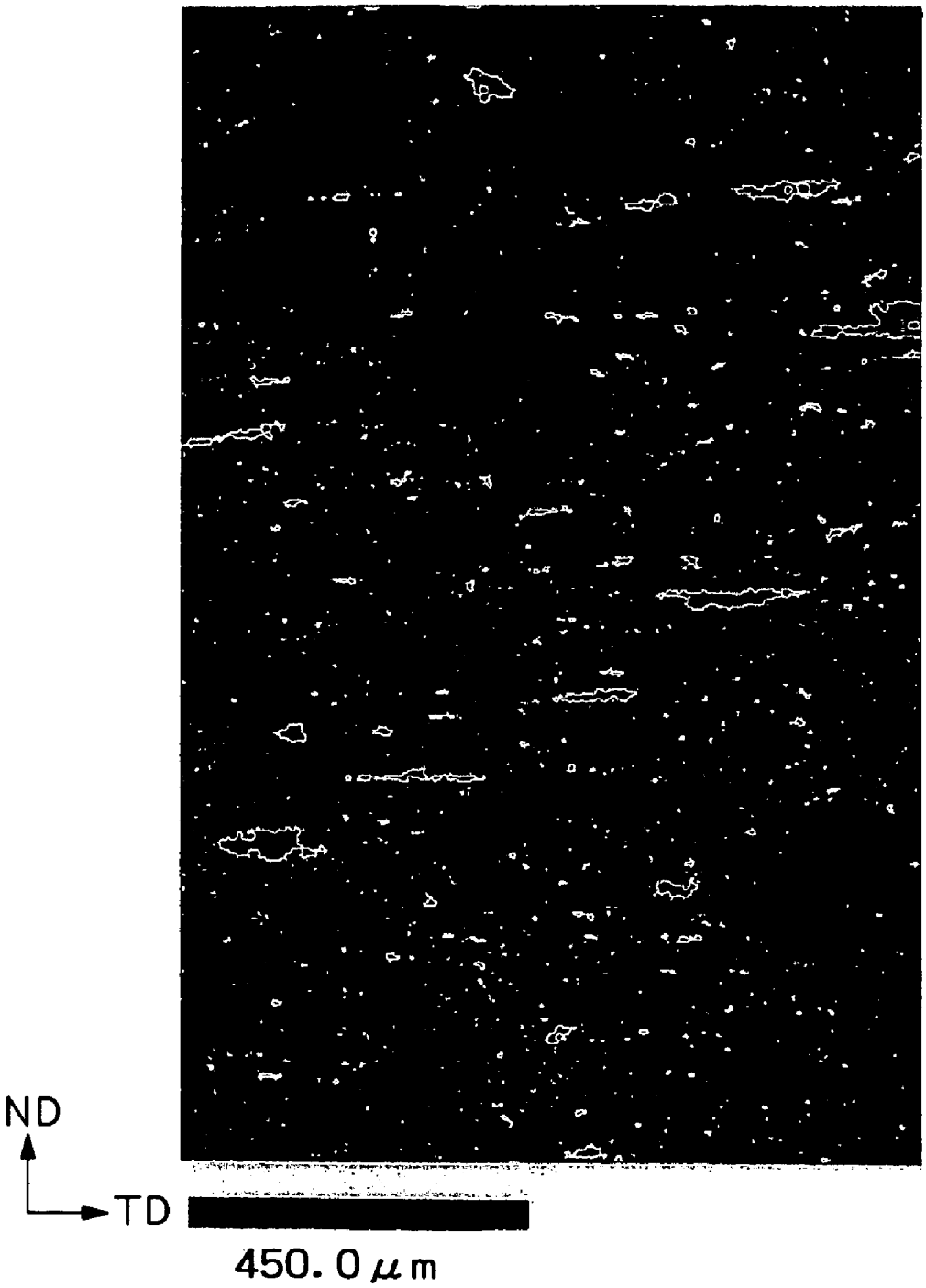
FIG. 4 shows the EBSP analysis results immediately before a cold rolling step of alloy No. 18.

On the other hand, FIG. 4 shows the EBSP analysis result immediately before cold rolling step at the ¼ t portion of No. 18 alloy sheet. FIG. 4 indicates as follows. The size along the sheet thickness direction of each crystal orientation was sufficiently large, and the calculated average value was 72 μm, which exceeds 50 μm (No. 18 of Table 4). As a result, ridging marks were produced.

Comparison of the results with other alloy sheets also indicates that there is a distinct interrelationship between the average value of the crystal sizes along the sheet thickness direction after the intermediate annealing immediately before the cold rolling step or during the cold rolling, and the left-hand side value of the expression (1) and the production of ridging marks. Namely, when the average value is not more than 50 μm, the left-hand side of the expression (1) is 1.0 or less, and no ridging mark is produced. On the other hand, when the average value exceeds 50 μm, the left-hand side of the expression (1) exceeds 1.0, and ridging marks are produced during press forming.

What is claimed is:

1. An Al—Mg—Si alloy sheet, comprising Mg in an amount of 0.4 to 1.9 mass % and Si in an amount of 0.2 to 1.9 mass %, wherein respective textures of Cube orientation, CR orientation, RW orientation, Goss orientation, Brass orientation, S orientation, Cu orientation, and PP orientation satisfy the conditions of the following expression (1):

$$([Cube]+[CR]+[RW]+[Goss]+[Brass]+[S]+[Cu]+[PP])/8 \leqq 1.0\ (\%) \quad (1)$$

(where [x] denotes the standard deviation (%) of the area ratio of an orientation x in a sheet cross section every 500 μm along the sheet width direction); and wherein the Al—Mg—Si alloy sheet is produced by a process comprising cold rolling an intermediate material, which comprises Mg in an amount of 0.4 to 1.9 mass % and Si in an amount of 0.2 to 1.9 mass %, which is in shape of a sheet, and in which the average value of the crystal sizes along the sheet thickness direction of textures of respective orientations is 50 μm or less.

2. The Al—Mg—Si alloy sheet according to claim 1, further comprising at least one selected from the group consisting of 1.0 mass % or less of Fe, 0.3 mass % or less of Mn, 0.3 mass % or less of Cr, 0.3 mass % or less of Zr, 0.3 mass % or less of V, and 0.1 mass % or less of Ti.

3. The Al—Mg—Si alloy sheet according to claim 1, further comprising at least one of 1.0 mass % or less of Cu and 1.0 mass % or less of Zn.

4. A method for manufacturing the Al—Mg—Si alloy sheet according to claim 1, comprising: subjecting an aluminum alloy containing Mg in an amount of 0.4 to 1.9 mass % and Si in an amount of 0.2 to 1.9 mass % to hot rolling and cold rolling; and subjecting the aluminum alloy to intermediate annealing immediately before the cold rolling or during the cold rolling, wherein the intermediate annealing conditions are set such that the annealing temperature is 150 to 320° C. and the annealing time is 20 hours or more.

5. The method according to claim 4, wherein the starting temperature of the hot rolling is set at 500° C. or less, and the finishing temperature of the hot rolling is set at 250° C. or less.

6. The method according to claim 4, wherein the cold rolling reduction in the cold rolling is set at 70% or more.

* * * * *

UNITED STATES PATENT AND TRADEMARK OFFICE

CERTIFICATE OF CORRECTION

PATENT NO. : 7,364,630 B2
APPLICATION NO. : 10/807240
DATED : April 29, 2008
INVENTOR(S) : Matsumoto et al.

It is certified that error appears in the above-identified patent and that said Letters Patent is hereby corrected as shown below:

On the title page, Item (73), the Assignee's name is incorrect. Item (73) should read:

-- (73) Assignee: Kabushiki Kaisha Kobe Seiko Sho (Kobe Steel, Ltd.)
Kobe-shi (JP) --

Signed and Sealed this

Eighth Day of July, 2008

JON W. DUDAS
*Director of the United States Patent and Trademark Office*